US005433643A

United States Patent [19]

Pratt

[11] Patent Number: 5,433,643

[45] Date of Patent: Jul. 18, 1995

[54] TOY DOLL APPARATUS

[76] Inventor: Rosanna M. Pratt, Dam Rd. Box 196, Chittenden, Vt. 05737

[21] Appl. No.: 225,339

[22] Filed: Apr. 8, 1994

[51] Int. Cl.[6] ..... A63H 3/00; A63H 13/02; A63H 3/36

[52] U.S. Cl. ..... 446/73; 446/268; 446/296; 446/390; D28/80; D6/450; D6/453

[58] Field of Search ..... 410/411; D6/449, 450, D6/453; D28/73–77, 79, 80; 132/1 R, 286, 73; 446/71, 72, 73, 75, 76, 77, 81, 219, 268, 295, 296, 385, 390, 391, 394

[56] References Cited

U.S. PATENT DOCUMENTS

| | | | |
|---|---|---|---|
| D. 145,811 | 10/1946 | Linduska | D28/79 X |
| D. 210,921 | 4/1968 | Downs | D6/450 |
| D. 242,670 | 12/1976 | Northrup | D6/450 |
| D. 288,458 | 2/1987 | Belue et al. . | |
| D. 305,559 | 1/1990 | Begley | D6/453 X |
| D. 332,290 | 1/1993 | Altiery | D6/453 X |
| 3,753,312 | 8/1973 | Hughes, Jr. . | |
| 3,861,078 | 1/1975 | Snyder . | |
| 4,563,163 | 1/1986 | Herbstler et al. . | |
| 5,022,886 | 6/1991 | Jenkins . | |
| 5,207,728 | 5/1993 | Fogarty et al. | 446/98 |
| 5,246,020 | 9/1993 | Wu | D28/80 X |
| 5,318,469 | 6/1994 | Unelp et al. | 446/73 |

FOREIGN PATENT DOCUMENTS

| | | | |
|---|---|---|---|
| 726548 | 1/1966 | Canada | 446/73 |
| 1146795 | 4/1963 | Germany | 446/390 |

*Primary Examiner*—Robert A. Hafer
*Assistant Examiner*—D. Neal Muir

[57] ABSTRACT

A new and improved toy doll apparatus includes a base assembly and a simulated human doll assembly supported by the base assembly. The doll assembly includes feet assemblies supported by the base assembly. A torso assembly is supported by the feet assemblies and the base assembly. Arm/hand assemblies are supported by the torso assembly, and a head assembly is supported by the torso assembly. The head assembly includes pierced cars. Boots are supported by the feet assemblies. The boots include storage compartments adapted for storing a comb and a brush. An earring storage assembly is supported by an arm/hand assembly. The earring storage assembly includes an earring support base unit and a plurality of apertures for receiving earrings. Fingers on the arm/hand assemblies are adapted to be coated with finger nail polish. An apron is adapted to be supported by the torso assembly, and hook assemblies are supported by the apron for storing necklaces and/or bracelets. A mirror is supported by the torso assembly. The earring support base unit of the earring storage assembly is in a form of a flower which includes a plurality of petals and a stem. Apertures adapted for receiving earrings are located on the petals of the flower. The stem of the earring support base unit includes a hook adapted to support ribbons. The mirror is located under the apron. The apron includes a plurality of elastic loops adapted to receive bows.

11 Claims, 3 Drawing Sheets

FIG 5
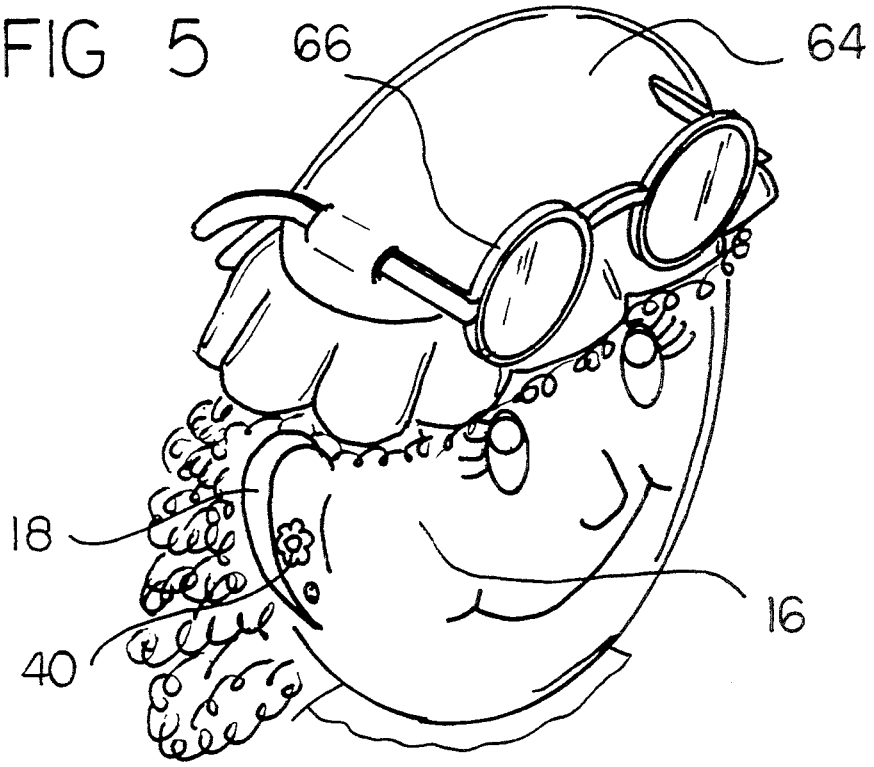
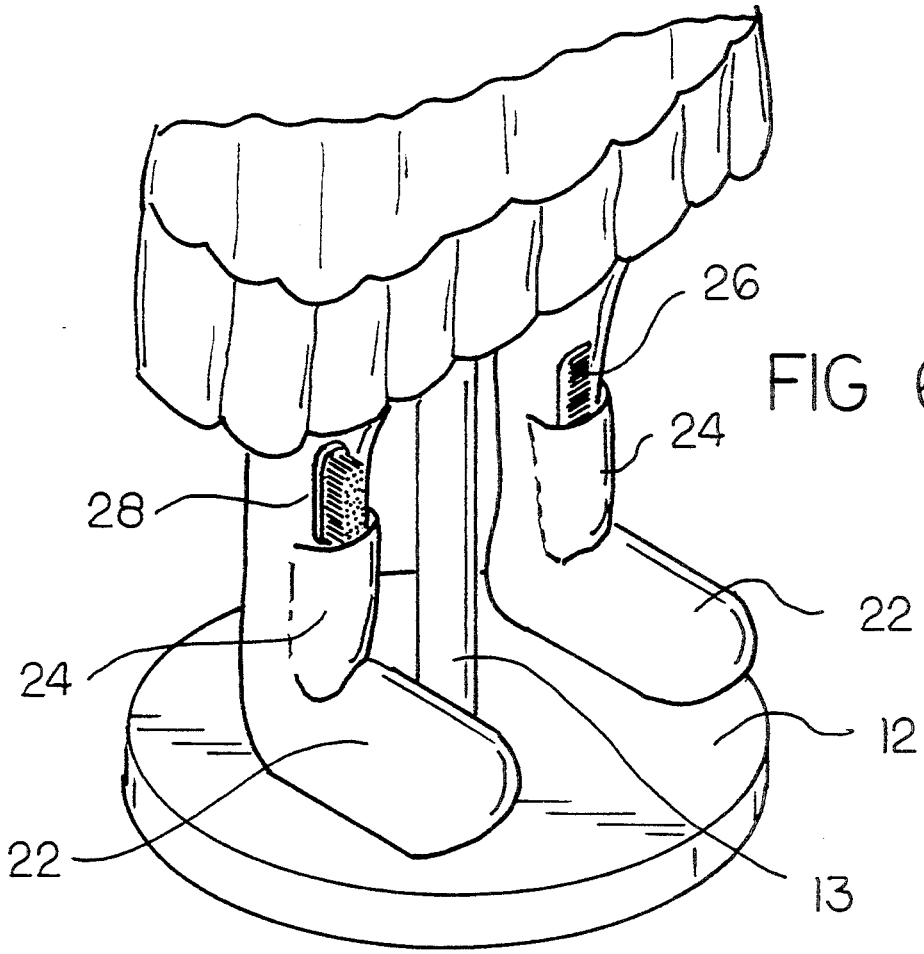
FIG 6

TOY DOLL APPARATUS

BACKGROUND OF THE INVENTION

1. Field of the Invention

The present invention relates generally to toy dolls and, more particularly, to toy dolls that include educational features.

2. Description of the Prior Art

Toy dolls serve a variety of useful functions for youngsters. They assist in play and also give opportunities for educational activity. Unfortunately, a number of dolls currently marketed are directed to activities of a violent nature. Among many parents nowadays there is a strong concern that violence is too pervasive in society. As a result, many parents are eager to provide their children with dolls that do not relate to violent activities.

Relative proportions of parts of dolls are often provided so that a head portion is relatively large compared to other body portions of the doll. For example, the head portion is relatively large compared to the feet and leg portions. The relatively large head is a characteristic that is generally regarded as being cute. In this respect, it is desirable for toy doll to have a head that is relatively large in comparison to the rest of the doll.

When young girls play with a toy doll, it may be desirable for the doll to promote educational activities that specifically relate to feminine concerns. For example, fingers on the doll may receive nail polish. Portions of the doll may receive hair barrettes.

It may also be desirable for a toy doll to promote other activities such a storing other personal items in an organized manner. For example, it would be desirable for a toy doll to have provisions for storing necklaces, bracelets, and earrings.

More specifically, with respect to storing earrings, it would be desirable for a toy doll to have simulated pierced ears so that earrings can be stored on the pierced ears. Since pierced ears offer only a limited number of storage locations for earrings, it would be desirable for a toy doll to provide storage facilities for more earrings than can fit onto the pierced ears.

For a toy doll that is used for storing a plurality of items, it would be desirable for the doll to have a stable base. The stable base prevents the doll from readily falling over under the burden of the items stored.

Other personal items for which it would be desirable for a toy doll to have storage provisions include a comb and a brush. It would also be desirable for a toy doll to have a number of pockets that can be used for storing miscellaneous items.

For putting on a number of personal items, it is desirable that a person employ a mirror. In this respect, it would be desirable if a toy doll were provided which included a mirror to aid in the proper placement of personal items on a person.

Throughout the years, a number of innovations have been developed relating to toy dolls, and the following U.S. patents are representative of some of those innovations: U.S. Pat. Nos. 3,753,312; 3,861,078; 4,563,163; 5,022,886; and Des. 288,458. None of the above-cited patents discloses a variety of storage facilities for storing a number of personal items, Thus, while the foregoing body of prior art indicates it to be well known to use toy dolls for recreational and educational activities, the prior art described above does not teach or suggest a toy doll apparatus which has the following combination of desirable features: (1) does not relate to violent activities; (2) has a head that is relatively large in comparison to the rest of the doll; (3) promotes educational activities that specifically relate to feminine concerns; (4) has fingers on the doll which may receive nail polish; (5) receives hair barrettes; (6) has provisions for storing necklaces, bracelets, and earrings; (7) has simulated pierced ears so that earrings can be stored on the pierced ears; (8) provides storage facilities for more earrings than can fit onto the pierced ears; (9). has a stable base; (10) has storage provisions for storing a comb and a brush; (11) has a number of pockets that can be used for storing miscellaneous items; and (12) includes a mirror to aid in the proper placement of personal items on a person. The foregoing desired characteristics are provided by the unique toy doll apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved toy doll apparatus which includes a base assembly and a simulated human doll assembly supported by the base assembly. The doll assembly includes feet assemblies supported by the base assembly. A torso assembly is supported by the feet assemblies and the base assembly. Arm/hand assemblies are supported by the torso assembly, and a head assembly is supported by the torso assembly. The head assembly includes pierced ears.

Boots are supported by the feet assemblies. The boots include storage compartments adapted for storing a comb and a brush. An earring storage assembly is supported by an arm/hand assembly. The earring storage assembly includes an earring support base unit and a plurality of apertures for receiving earrings. Fingers on the arm/hand assemblies are adapted to be coated with finger nail polish. An apron is adapted to be supported by the torso assembly, and hook assemblies are supported by the apron for storing necklaces and/or bracelets. A mirror is supported by the torso assembly.

The earring support base unit of the earring storage assembly is in a form of a flower which includes a plurality of petals and a stem. Apertures adapted for receiving earrings are located on the petals of the flower. The stem of the earring support base unit includes a hook adapted to support ribbons.

The mirror is located under the apron. The apron includes a plurality of elastic loops adapted to receive bows. A hat is supported by the head assembly. Eyeglasses are supported by the hat. A basket is supported by one of the arm/hand assemblies. The apron includes a plurality of pockets. A perfume-containing necklace is supported by a neck portion of the head assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved toy doll apparatus which has all of the advantages of the prior art and none of the disadvantages.

It is another object of the present invention to provide a new and improved toy doll apparatus which may be easily and efficiently manufactured and marketed.

It is a further object of the present invention to provide a new and improved toy doll apparatus which is of durable and reliable construction.

An even further object of the present invention is to provide a new and improved toy doll apparatus which is susceptible of a low cost of manufacture with regard to both materials and labor, and which accordingly is then susceptible of low prices of sale to the consuming public, thereby making such toy doll apparatus available to the buying public.

Still yet a further object of the present invention is to provide a new and improved toy doll apparatus which does not relate to violent activities.

Still another object of the present invention is to provide a new and improved toy doll apparatus that has a head that is relatively large in comparison to the rest of the doll.

Yet another object of the present invention is to provide a new and improved toy doll apparatus, which promotes educational activities that specifically relate to feminine concerns.

Even another object of the present invention is to provide a new and improved toy doll apparatus that has fingers on the doll which may receive nail polish.

Still a further object of the present invention is to provide a new and improved toy doll apparatus which receives hair barrettes.

Yet another object of the present invention is to provide a new and improved toy doll apparatus that has provisions for storing necklaces, bracelets, and earrings.

Still another object of the present invention is to provide a new and improved toy doll apparatus which has simulated pierced ears so that earrings can be stored on the pierced ears.

Yet another object of the present invention is to provide a new and improved toy doll apparatus that provides storage facilities for more earrings than can fit onto the pierced ears.

Still a further object of the present invention is to provide a new and improved toy doll apparatus that has a stable base.

Yet another object of the present invention is to provide a new and improved toy doll apparatus which has storage provisions for storing a comb and a brush.

Still a further object of the present invention is to provide a new and improved toy doll apparatus that has a number of pockets that can be used for storing miscellaneous items, Yet another object of the present invention is to provide a new and improved toy doll apparatus which includes a mirror to aid in the proper placement of personal items on a person.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an enlarged perspective view of the head portion of the embodiment of the invention shown in FIG. 1 with an earring stored on a simulated pierced ear.

FIG. 6 is an enlarged perspective view of the feet and base portion of the embodiment of the invention shown in FIG. 1 with a comb and brush being stored.

DESCRIPTION OF THE PREFERRED EMBODIMENT

With reference to the drawings, a new and improved toy doll apparatus embodying the principles and concepts of the present invention will be described.

Figure 1:
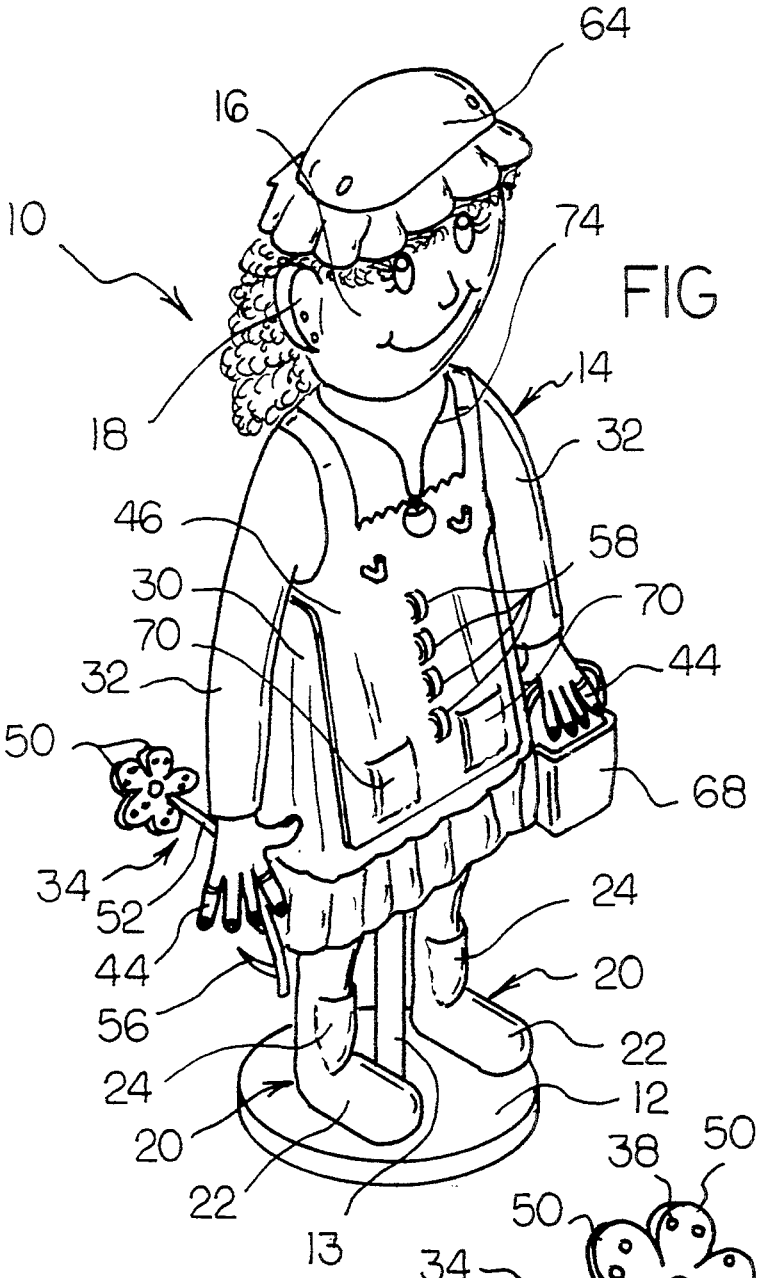
FIG. 1 is a perspective view showing a preferred embodiment of the toy doll apparatus of the invention.
Figure 2:
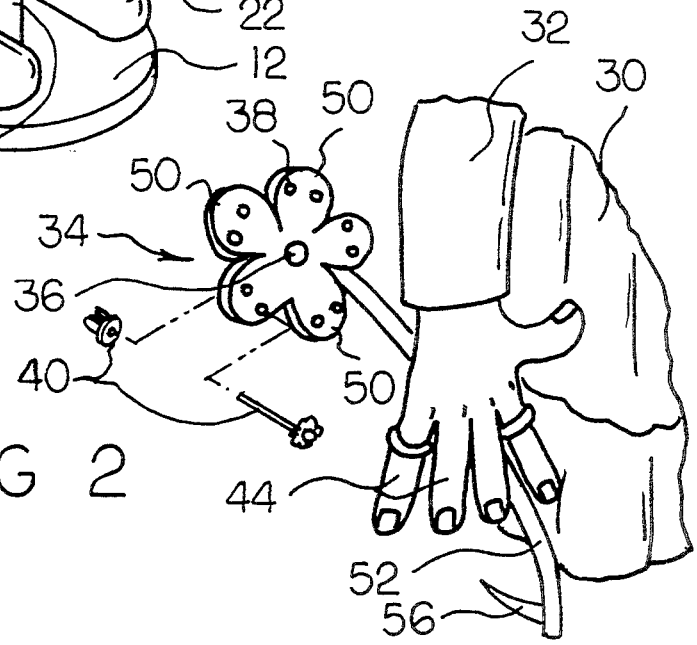
FIG. 2 is an enlarged perspective view of the hand portion of the embodiment of the invention shown in FIG. 1.
Figure 3:
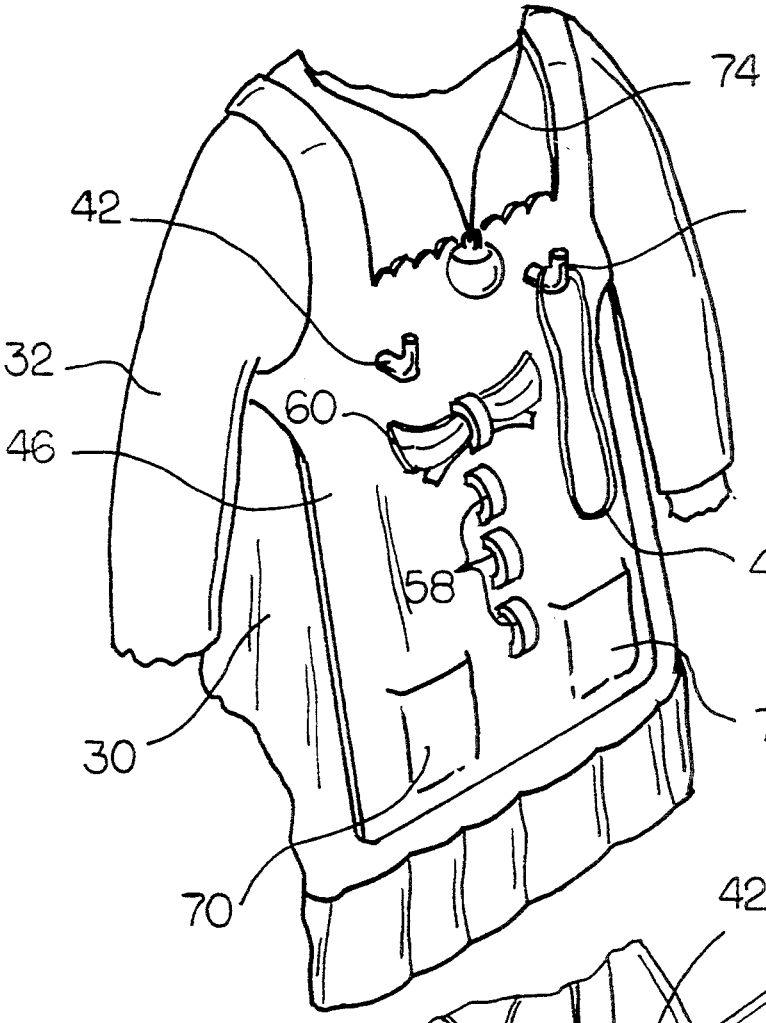
FIG. 3 is an enlarged perspective view of a portion of the embodiment of the toy doll apparatus of FIG. 1 showing some items stored on the apparatus.
Figure 4:
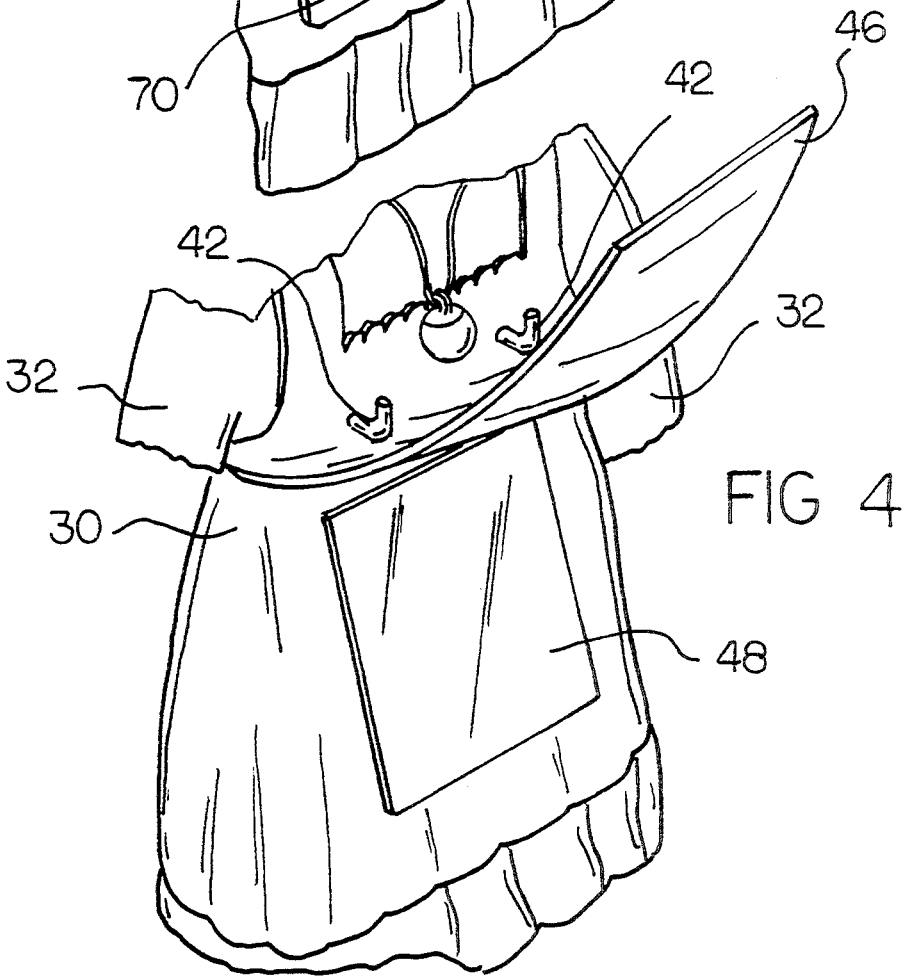
FIG. 4 is a perspective view of the embodiment of the invention shown in FIG. 3 showing a mirror.

Turning to FIGS. 1–6, there is shown an exemplary embodiment of the toy doll apparatus of the invention generally designated by reference numeral 10. In its preferred form, toy doll apparatus 10 includes a base assembly 12 and a simulated human doll assembly 14 supported by the base assembly 12. The doll assembly 14 includes feet assemblies 20 supported by the base assembly 12. A torso assembly 30 is supported by the feet assemblies 20 and the base assembly 12. Arm/hand assemblies 32 are supported by the torso assembly 30, and a head assembly 16 is supported by the torso assembly 30. The head assembly 16 includes pierced ears 18.

Boots 22 are supported by the feet assemblies 20. The boots 22 include storage compartments 24 adapted for storing a comb 26 and a brush 28. An earring storage assembly 34 is supported by an arm/hand assembly 32. The earring storage assembly 34 includes an earring support base unit 36 and a plurality of apertures 38 for receiving earrings 40. Fingers 44 on the arm/hand assemblies 32 are adapted to be coated with finger nail polish. An apron 46 is adapted to be supported by the torso assembly 30, and hook assemblies 42 are supported by the apron 46 for storing necklaces 47 and/or bracelets. A mirror 48 is supported by the torso assembly 30.

The base assembly 12 includes a pedestal member 13 which supports the torso assembly 30. The earring support base unit 36 of the earring storage assembly 34 is in a form of a flower which includes a plurality of petals 50 and a stem 52. Apertures 38 adapted for receiving earrings 40 are located on the petals 50 of the flower. The stem 52 of the earring support base unit 36 includes a hook 56 adapted to support ribbons.

The mirror 48 is located under the apron 46. By lifting the apron 46, the mirror 48 can be accessed. The apron 46 includes a plurality of elastic loops 58 adapted to receive bows 60. A hat 64 is supported by the head assembly 16. Eyeglasses 66 are supported by the hat 64. A basket 68 is supported by one of the arm/hand assemblies 32. The apron 46 includes a plurality of pockets 70. A perfume-containing necklace 74 is supported by a neck portion of the head assembly 16.

The size of the toy doll apparatus 10 of the invention can be any size that is desired. However, a convenient size that is adapted to store a wide variety of everyday items stands from 18 to 30 inches tall and can be conveniently placed on a dresser or a floor.

The components of the toy doll apparatus of the invention can be made from inexpensive plastic and cloth materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved toy doll apparatus that is low in cost, relatively simple in design and operation, and which may advantageously be used in play and educational activities without relating to violent activities. With the invention, a toy doll apparatus is provided which has a head that is relatively large in comparison to the rest of the doll. With the invention, a toy doll apparatus is provided which promotes educational activities that specifically relate to feminine concerns. With the invention, a toy doll apparatus is provided which has fingers on the doll which may receive nail polish. With the invention, a toy doll apparatus is provided which receives hair barrettes. With the invention, a toy doll apparatus is provided which has provisions for storing necklaces, bracelets, and earrings. With the invention, a toy doll apparatus is provided which has simulated pierced ears so that earrings can be stored on the pierced ears. With the invention, a toy doll apparatus provides storage facilities for more earrings than can fit onto the pierced ears. With the invention, a toy doll apparatus is provided which has a stable base. With the invention, a toy doll apparatus is provided which has storage provisions for storing a comb and a brush. With the invention, a toy doll apparatus is provided which has a number of pockets that can be used for storing miscellaneous items. With the invention, a toy doll apparatus is provided which includes a mirror to aid in the proper placement of personal items on a person.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved toy doll apparatus, comprising:

a base assembly, a simulated human doll assembly supported by said base assembly, wherein said doll assembly includes foot/boot assemblies supported by said base assembly, a torso assembly supported by said feet assemblies and said base assembly, arm/hand assemblies supported by said torso assembly, and a head assembly supported by said torso assembly, wherein said head assembly includes pierced ears, wherein said foot/boot assemblies include storage compartments adapted for storing a comb and a brush, one earring storage assembly supported by an arm/hand assembly, wherein said earring storage assembly includes an earring support base unit with a plurality of apertures for receiving earrings, fingers on said arm/hand assemblies adapted to be coated with finger nail polish, an apron adapted to be and supported by said torso assembly, hook assemblies supported by said apron for storing necklaces and/or bracelets, and a mirror supported by said torso assembly.

2. The apparatus described in claim 1 wherein said earring support base unit of said earring storage assembly is in a form of a flower which includes a plurality of petals and a stem.

3. The apparatus described in claim 2 wherein said apertures for receiving earrings are located on said petals of said flower.

4. The apparatus described in claim 2 wherein said stem of said earring support base unit includes a hook adapted to support ribbons.

5. The apparatus described in claim 1 wherein said mirror is located under said apron.

6. The apparatus described in claim 1 wherein said apron includes a plurality of elastic loops adapted to receive bows.

7. The apparatus described in claim 1, further including:

a hat supported by said head assembly.

8. The apparatus described in claim 7, further including:

eyeglasses supported by said hat.

9. The apparatus described in claim 1, further including:

a basket supported by one of said arm/hand assemblies.

10. The apparatus described in claim 1 wherein said apron includes a plurality of pockets.

11. The apparatus described in claim 1, further including:

a perfume-containing necklace supported a neck portion of said head assembly.

* * * * *